United States Patent [19]

Kohlstette et al.

[11] 4,044,945

[45] Aug. 30, 1977

[54] SELF-CLEANING CENTRIFUGAL SEPARATOR HAVING A MAIN PISTON VALVE DEFINING ONE SIDE OF THE SEPARATING CHAMBER AND CONNECTED TO AT LEAST ONE AUXILIARY PISTON VALVE

[75] Inventors: Werner Kohlstette; Gunthard Pautsch, both of Oelde, Germany

[73] Assignee: Westfalia Separator AG, Oelde, Germany

[21] Appl. No.: 686,614

[22] Filed: May 14, 1976

[30] Foreign Application Priority Data

May 16, 1975 Germany ..... 2521838

[51] Int. Cl.[2] ..... B04B 11/04

[52] U.S. Cl. ..... 233/20 A

[58] Field of Search ..... 233/20 R, 20 A

[56] References Cited

FOREIGN PATENT DOCUMENTS

| | | | |
|---|---|---|---|
| 516,174 | 2/1955 | Italy | 233/20 A |
| 923,497 | 4/1963 | United Kingdom | 233/20 A |

*Primary Examiner*—George H. Krizmanich

*Attorney, Agent, or Firm*—Burgess, Dinklage & Sprung

[57] ABSTRACT

A centrifuge constructed for the intermittent discharge of sludge having a main piston valve 3 for opening and closing of sludge discharge passageways 4, is provided with an auxiliary piston valve 9 mounted on the main piston valve 3 and having an opening chamber 11 and closing chamber 12, supplied with control fluids, so that the operation of auxiliary piston valve 9 is cumulative to the operation of the main piston valve 3 on both opening and closing of the main piston valve. The auxiliary piston valve 9 is mounted 10, 10*a* on the main piston valve 3 so that the auxiliary piston valve can shift on the main piston valve 3 to open and close dumping passageways 19 provided for emptying of the control chamber 8 of the main piston valve 3.

4 Claims, 1 Drawing Figure

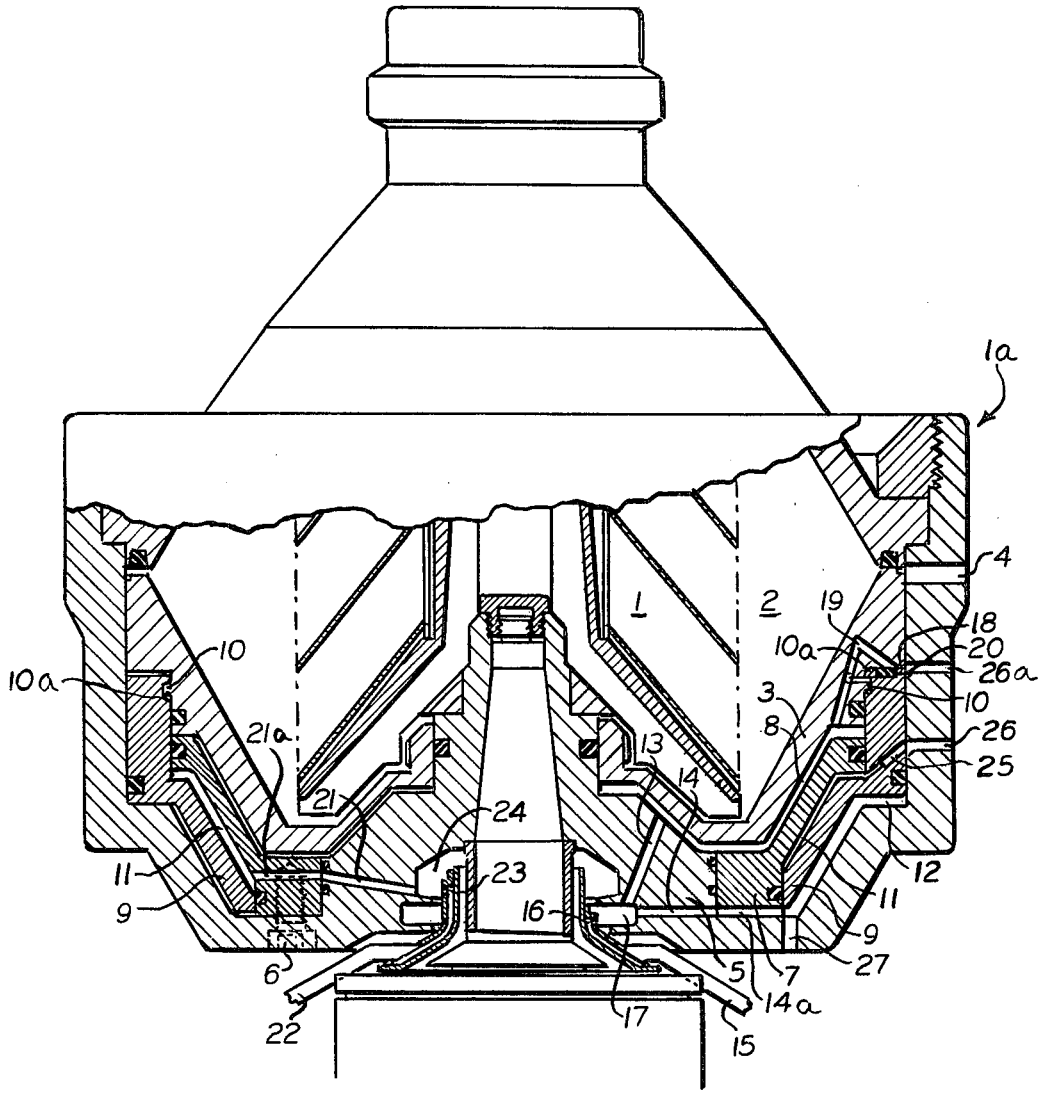
1a
4
1
2
19
18
20
26a
10a
10
3
8
26
25
10a
10
21a
13
14
21
24
11
23
12
9
16
11
9
27
6
5
7
14a
22
17
15

SELF-CLEANING CENTRIFUGAL SEPARATOR HAVING A MAIN PISTON VALVE DEFINING ONE SIDE OF THE SEPARATING CHAMBER AND CONNECTED TO AT LEAST ONE AUXILIARY PISTON VALVE

BACKGROUND

The invention relates to self-cleaning centrifugal separators having a main piston valve defining one side of the separating chamber and connected with at least one auxiliary piston valve, the main piston valve opening and closing the sludge ejection apertures in the periphery of the drum and the auxiliary piston valve connected with the main piston valve additionally influencing the opening action of the main piston valve. A separator of this kind is known, for example, through French Pat. No. 963,524.

Separators of this type of construction have only one control chamber located on the side of the main piston valve that is remote from the separating chamber. When control fluid is admitted into this chamber, the fluid pressure that builds up and acts upon the outer side of the main piston valve moves the latter to the closed position. When the control fluid is let out of this chamber, the pressure of the drum charge acting on the inner side moves the main piston valve to its open position. The auxiliary piston valve fixedly joined by bolts to the main piston valve produces, by means of the control fluid, an additional opening force which is transmitted to the main piston valve.

This additional opening force is necessary in types of separators in which the main piston valve defines one side of the separating chamber, because the pressure acting to open the main piston valve in the event, for example, of a complete emptying, diminishes as the level of the drum charge drops, so that the main piston valve does not reach its full open position and thus also does not open the annular gap to its full width. Consequently, the uniform ejection of solids which, for example, tend to cake up or mat together is not assured. Solids which remain unequally distributed in the separator, however, can result in severe imbalance of the separator drum.

Another type of construction is known through German Pat. No. 2,041,371 (U.S. Pat. No. 3,754,701), in which the main piston valve defining one side of the separating chamber is provided with a cap over its central portion, which is carried on an axial projection of the piston valve with the use of a sealing ring sealing it off from the separating chamber, and forms with the main piston valve a chamber which can be charged with control fluid. Since this chamber, which is always filled with control fluid, produces a constant opening force, the annular gap is opened to its full width by the main piston valve for the uniform ejection of the solids even as the level of the drum charge recedes.

In the centrifugal separation of specifically heavier liquids and suspended solids which are of even greater specific weight, it can happen that the ratio between the closing force and the opening force—especially in the case of partial emptying where the full opening force is still largely sustained—is not great enough, and the main piston valve therefore does not bring the drum into the closed position rapidly enough or fails to close it tightly enough, i.e., the closing force is too weak.

Both of the above-described types of construction—the one based on French Pat. No. 963,524 and the one based on German Pat. No. 2,041,371—will then fail to operate satisfactorily, since an additional opening force is provided, but no additional closing force. Furthermore, the chamber of the type of construction described in the German patent is located above the piston valve within the separating chamber, and is separated from the separating chamber, and thus from the material being separated, only by a sealing ring. If this ring, which is subjected to severe wear in the emptying actions, develops a leak, either control fluid will get into the separating chamber and mix with the material being centrifuged, or the material being centrifuged will get into this chamber, and both of these circumstances must be avoided.

In the centrifugal separation of fermentation liquids, bacterial cultures, liquid foods and the like, infections would immediately occur if control fluid should come in contact with the material being centrifuged.

An improvement over German Pat. No. 2,041,371 is described in German Pat. No. 2,263,664 (U.S. Pat. No. 3,905,292). In this improved design, the main piston valve surface that is acted upon to open the drum can be made by far smaller than in previously known centrifugal separators, so that the closing force will predominate sufficiently even in the case of liquids of substantially greater specific weight. The hydraulic chamber, which is provided in this design too, is nevertheless also located in the centrifugal separating chamber, with the same disadvantages mentioned before, and the arrangement of the chamber within the separating chamber additionally has a negative effect on the disk stack area of the drum and hence on the degree of separation.

THE INVENTION

It is the object of the invention to construct a centrifugal separator having a main piston valve defining one side of the separating chamber such that, by means of a second piston valve, i.e., an auxiliar piston valve, both an additional opening force and an additional closing force will be produced, so that, in every kind of emptying operation, whether a complete emptying or a partial emptying is to be performed, and regardless of the specific weight of the liquid being centrifuged or of the solids being separated, the fully open position of the main piston valve will be attained, and the liquid being centrifuged will not be infected by control fluid penetrating into the sludge chamber.

The invention is characterized by the fact that the main piston valve connected to the auxiliary piston valve is separated from the main piston valve by a partition ring, a closing chamber is disposed on one side of the auxiliary piston valve and an opening chamber on the other, the auxiliary piston valve is operated for opening and closing by means of a control fluid, and the closing and opening forces associated therewith are transmitted to the main piston valve and added.

In further development of the invention, the auxiliary piston valve is constructed so that it serves the function of the valves required for the opening and closing movements of the main piston valve in the types of construction known hitherto, so that these additional valves, which are a frequent source of trouble, can be eliminated. The result is a substantially simpler, less expensive and more reliable construction. In this type of design, a loose connection is provided between the main piston valve and the auxiliary piston valve.

SUMMARY

Thus, the invention provides a centrifugal separator constructed for intermittent discharge of sludge, comprising a rotatably mounted separator drum having an upper end and a lower end member, and at least one sludge discharge passageway disposed at the radially outward periphery of the drum. One of the end members comprises a main piston valve movable axially to open and close the sludge discharge passageway for desludging. A closing chamber is disposed in the drum outwardly of the piston valve for receiving and discharging control fluid for, respectively, forcing the main piston valve to the closed position and relieving force for initiating the moving of the main piston valve to its open position under the influence of material filling the drum. Means are provided for supplying fluid to the closing chamber and for discharging fluid therefrom.

The invention provides the improvement which comprises an auxiliary piston valve mounted in the drum on the main piston valve and disposed axially outwardly of the main piston valve. A partition ring is mounted in the drum and separates the auxiliary piston valve from the main piston valve. The auxiliary piston valve is axially movable in the drum so that an auxiliary piston valve closing chamber is provided on the axially outward side of the auxiliary piston valve and an auxiliary piston valve opening chamber is provided on the axially inward side of the auxiliary piston valve. Means are provided for supplying control fluids to the auxiliary piston valve closing and opening chambers for, respectively, exerting a closing and opening force on the auxiliary piston valve. The mounting of the auxiliary piston on the main piston valve is such that said closing and opening forces on the auxiliary piston valve are transmitted to the main piston valve and add to the influence of the control fluid of the closing chamber of the main piston valve, i.e. when the main piston valve is being urged to the closed position by control fluid in the control chamber of the main piston valve, the auxiliary piston valve is urging the main piston valve to the closed position, and when the main piston valve is being urged to the open position the auxiliary piston valve is urging the main piston valve to the open position.

In a preferred embodiment, means define a passageway from the closing chamber of the main piston valve to without the drum for the discharging of control fluid for operation of the main piston valve, and part of the auxiliary piston valve closes said passageway with the main piston valve and auxiliary piston valve closing the sludge discharge passageway. The auxiliary piston valve is mounted on the main piston valve so that the auxiliary piston valve is movable on the main piston valve so as to open said passage from the closing chamber of the main piston valve when control fluid is supplied to the auxiliary piston valve opening chamber, and close said passageway from the closing chamber of the main piston when control fluid is supplied to the auxiliary piston valve closing chamber. In this embodiment, the mounting of the auxiliary piston valve on the main piston valve can be such that the auxiliary piston valve is shiftable on the main piston valve between two positions. A sealing means can be mounted on the auxiliary piston valve for sealing the passageway from the closing chamber of the main piston valve.

EXAMPLE

A centrifuge of the invention, constructed for intermittent discharge of sludge, is represented in the drawing, the right side of the drawing representing the drum in the closed state and the left side in the open state.

The disk stack area 1 and the solids area 2 of the drum 1*a* are defined on one side by the main piston valve 3, which in its axial movements opens and closes the apertures 4 for the ejection of the solids. Between the main piston valve 3 and the adjacent drum bottom 5 and partition ring 7 which is fastened to drum bottom 5 by means of the bolts 6, is the closing chamber 8. Between the partition ring 7 and the drum bottom 5 there is disposed the axially movable and sealingly guided auxiliary piston valve 9, which is loosely connected to the main piston valve 3 by means, for example, of the projections 10 and 10*a*. Above the auxiliary piston valve 9, and bounded by the partition ring 7, there is the opening chamber 11, and below the auxiliary piston valve 9, and bounded by the drum bottom 5, there is the closing chamber 12 for the auxiliary piston valve 9.

In the drum bottom 5 are passages 13 and 14, as well as 14*a* in partition ring 7, for the filling of closing chambers 8 and 12, the passages and closing chambers being filled with control fluid in a known manner through an inlet line 15, bores 16 and the catch trough 17, the control fluid remaining in chambers 8 and 12 during the centrifugation and exerting a closing foce on both piston valves, and the closing pressure of the auxiliary piston valve 9 being transmitted to the bottom side of the main piston valve 3 at the surface 18 so that an addition of the closing forces is accomplished.

In the main piston valve 3 there are provided dumping bores 19 which during the centrifugation are closed by the seals 20 installed at the surface 18 of the auxiliary piston valve 9.

For the procedure of opening the drum, passages 21 and 21*a* are disposed in the drum bottom 5 and in the partition ring 7, these passages being fed with control fluid through an inlet line 22, bores 23 and catch trough 24 and filling the opening chamber 11. The control fluid, which is delivered in excess, leaves the chamber 11 at the outer periphery through bores or nozzles 25 in the auxiliary piston valve 9 and associated bores 26 in the drum bottom 5.

Due to the opening pressure building up in chamber 11 and exceeding the closing pressure, the axially movable auxiliary piston valve 9 is moved downwardly by an amount corresponding to the gap formed between the projections 10 and 10*a* and uncovers the bores 19 from which the closing fluid escapes from chamber 8 through the bores 26*a* due to the centrifugal force, and thus the closing pressure below the main piston valve 3 is very quickly dissipated. The liquid being separated in the disk stack area 1 and the solids collecting in the solids area 2 exert an opening pressure on the main piston valve 3 and thus produce an axial displacement, so that the apertures 4 for the discharge of the solids are uncovered. The opening force on the main piston valve 3 is at the same time augmented by the opening force acting on the auxiliary piston valve 9 connected to the main piston valve 3.

Upon the axial displacement of the auxiliary piston valve 9, the control fluid is displaced from chamber 12 through bores 27 in the drum bottom 5.

Complete or partial emptyings are accomplished depending on the amount of control fluid that is needed for the opening or closing action. For a complete emptying a larger amount of fluid is needed, and for a partial emptying of the drum a smaller amount is needed.

What is claimed is:

1. In a centrifugal seprator constructed for intermittent discharge of sludge, comprising:

a rotatably mounted separator drum having an upper end member and a lower end member, and at least one sludge discharge passageway disposed at the radially outward periphery of the drum, one of said end members comprising a main piston valve movable axially to open and close the sludge discharge passageway for desludging, a closing chamber disposed in the drum outwardly of the main piston valve for receiving and discharging control fluid for, respectively, forcing the main piston valve to the closed position and relieving force for initiating the moving of the main piston valve to its open position under the influence of material filling the drum, means for supplying fluid to the closing chamber and means for discharging fluid therefrom, the improvement which comprises:

an auxiliary piston valve mounted in the drum and on the main piston valve and disposed axially outwardly of the main piston valve, a partition ring mounted in the drum and separating a portion of the auxiliary piston valve from the main piston valve, the auxiliary piston valve being axially moveable in the drum so that an auxiliary piston valve closing chamber is provided on the axially outward side of the auxiliary piston valve and an auxiliary piston valve opening chamber is provided on the axially inward side of the auxiliary piston valve, and means for supplying control fluids to the auxiliary piston valve closing and opening chamber for, respectively, exerting a closing and opening force on the auxiliary piston valve, the mounting of the auxiliary piston valve on the main piston valve being such that said closing and opening forces on the auxiliary piston valve are transmitted to the main piston valve and add to the influence of the control fluid of the closing chamber of the main piston valve.

2. Separator of claim 1, and means defining a passageway from the closing chamber of the main piston valve to outside the drum for said discharging of control fluid for operation of the main piston valve, part of the auxiliary piston valve closing said passageway with the main piston valve and auxiliary piston valve closing the slude discharge passageway, the auxiliary piston valve being mounted on the axially outward side of the main piston valve so that the axially piston valve is movable on the main piston valve so as to open said passageway from the closing chamber of the main piston valve when control fluid is supplied to the auxiliary piston valve opening chamber, and close said passageway from the closing chamber of the main piston valve when control fluid is supplied to the auxiliary piston valve closing chamber.

3. Separator of claim 2, wherein the mounting of the auxiliary piston valve is shiftable on the main piston valve between two positions.

4. Separator of claim 1, wherein a sealing means is mounted on the auxiliary piston valve for sealing the passageway from the closing chamber of the main piston valve.

* * * * *

UNITED STATES PATENT AND TRADEMARK OFFICE

CERTIFICATE OF CORRECTION

PATENT NO. : 4,044,945

DATED : August 30, 1977

INVENTOR(S) : Werner Kohlstette and Gunthard Pautsch

It is certified that error appears in the above-identified patent and that said Letters Patent are hereby corrected as shown below:

Column 6, line 19, change "axially" to --auxiliary--

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*